US010344390B2

(12) United States Patent
Renaudier et al.

(10) Patent No.: US 10,344,390 B2
(45) Date of Patent: Jul. 9, 2019

(54) ALUMINIUM SMELTER COMPRISING A COMPENSATING ELECTRIC CIRCUIT

(71) Applicant: Rio Tinto Alcan International Limited, Montreal (CA)

(72) Inventors: Steeve Renaudier, Saint Michel de Maurienne (FR); Benoit Bardet, Villargondran (FR); Olivier Martin, Hermillon (FR); Christian Duval, La Ravoire (FR)

(73) Assignee: Rio Tinto Alcan International Limited, Montreal (CA)

( * ) Notice: Subject to any disclaimer, the term of this patent is extended or adjusted under 35 U.S.C. 154(b) by 409 days.

(21) Appl. No.: 14/911,099

(22) PCT Filed: Jul. 30, 2014

(86) PCT No.: PCT/CA2014/050722
§ 371 (c)(1),
(2) Date: Feb. 9, 2016

(87) PCT Pub. No.: WO2015/017924
PCT Pub. Date: Feb. 12, 2015

(65) Prior Publication Data

US 2016/0201208 A1 Jul. 14, 2016

(30) Foreign Application Priority Data

Aug. 9, 2013 (FR) ..... 13 01910

(51) Int. Cl.
*C25C 3/16* (2006.01)
*C25C 3/24* (2006.01)
(Continued)

(52) U.S. Cl.
CPC ..... *C25C 3/16* (2013.01); *C25C 3/20* (2013.01); *C25C 3/24* (2013.01); *C25C 7/005* (2013.01)

(58) Field of Classification Search
CPC ..... C25C 3/06–3/24; C25C 3/16; C25C 3/20; C25C 7/005
See application file for complete search history.

(56) References Cited

U.S. PATENT DOCUMENTS 3,063,919 A 11/1962 Jouguet et al.
4,169,034 A 9/1979 Morel et al.
(Continued)

FOREIGN PATENT DOCUMENTS

CA 1148115 A 6/1983
CA 2607479 A1 1/2007
(Continued)

OTHER PUBLICATIONS

Sep. 22, 2014—International Search Report of PCT/CA2014/050722.

*Primary Examiner* — Ciel P Thomas
(74) *Attorney, Agent, or Firm* — Banner & Witcoff, Ltd.

(57) ABSTRACT

This aluminum smelter comprises a row of cells (50) arranged transversely in relation to the length of the row, the cells (50) individually comprising an anode (52), rising and connecting electrical conductors (54) running upwards along the two opposite longitudinal edges of the cell (50) to route the electrolysis current towards the anode (52), and a cathode (56) through which pass cathode conductors (55) connected to cathode outputs connected to linking conductors to route the electrolysis current to the rising and connecting electrical conductors of the next cell (50). Furthermore the aluminum smelter comprises a compensating electrical circuit separate from the electrical circuit through which the electrolysis current flows, running beneath the
(Continued)

Figure 1:
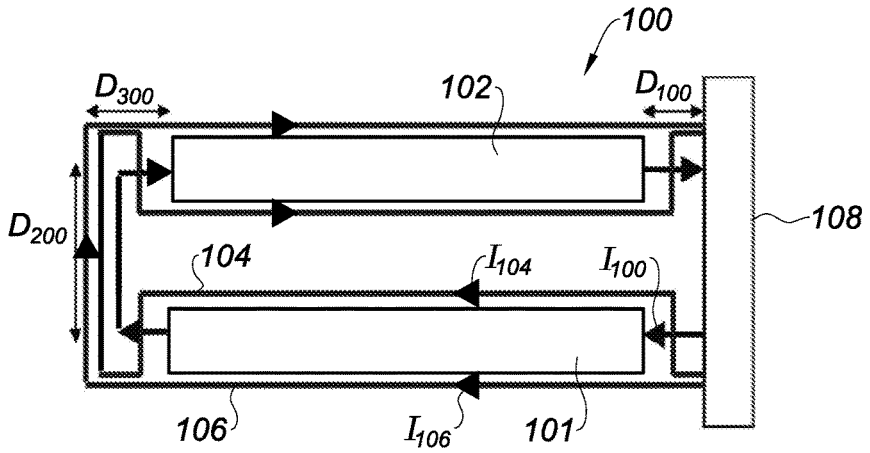

cells (50), through which a compensating current may flow beneath the cells (50) in a direction opposite to the overall direction of flow of the electrolysis current.

23 Claims, 4 Drawing Sheets

(51) Int. Cl.
*C25C 7/00* (2006.01)
*C25C 3/20* (2006.01)

(56) References Cited

U.S. PATENT DOCUMENTS 4,326,939 A * 4/1982 Schmidt-Hatting ..... C25C 3/16 204/230.5
4,654,133 A * 3/1987 Casdas ..... C25C 3/16 204/244
4,713,161 A * 12/1987 Chaffy ..... C25C 3/16 204/244
2007/0205099 A1 9/2007 Le Hervet et al.
2007/0256930 A1* 11/2007 Linnerud ..... C25C 3/16 204/267
2008/0041718 A1* 2/2008 Pingin ..... C25C 3/16 204/242
2008/0078674 A1* 4/2008 Platonov ..... C25C 3/16 204/279
2014/0138241 A1 5/2014 Duval et al.

FOREIGN PATENT DOCUMENTS

CA 2585218 A1 10/2007
EP 0204647 A1 12/1986
FR 1079131 A 11/1954
FR 2425482 A1 12/1979
FR 2469475 A1 5/1981
FR 2868436 A1 10/2005
WO 2013007893 A2 1/2013

* cited by examiner

ALUMINIUM SMELTER COMPRISING A COMPENSATING ELECTRIC CIRCUIT

CROSS-REFERENCE TO RELATED APPLICATIONS

The present application is a U.S. National Phase filing of International Application No. PCT/CA2014/050722, filed on Jul. 30, 2014, designating the United States of America and claiming priority to French Patent Application No. 13/01910 filed Aug. 9, 2013, and the present application claims priority to and the benefit of both the above-identified applications, which are incorporated by reference herein in their entireties.

This invention relates to an aluminum smelter, a method for using the aluminum smelter, and a process for stirring the alumina in the electrolytic cells of such aluminum smelters.

It is known that aluminum can be produced industrially from alumina by electrolysis using the Hall-Heroult process. For this purpose, an electrolytic cell is used comprising a steel pot shell within which there is a lining of refractory materials, a cathode of carbon material, through which pass cathode conductors intended to collect the electrolysis current at the cathode to route it to the cathode outputs which pass through the bottom or sides of the pot shell, linking conductors extending substantially horizontally to the next cell from the cathode outputs, an electrolyte bath in which the alumina is dissolved, at least one anode assembly comprising at least one anode immersed in this electrolyte bath, an anode frame on which the anode assembly is suspended, and risers for the electrolysis current running upwards connected to linking conductors from the preceding electrolytic cell to route the electrolysis current from the cathode outputs to the anode frame and the anode assembly and anode in the next cell. The anodes are more particularly of the pre-baked anode type with pre-baked carbon blocks, i.e. baked before they are placed in the electrolytic cell.

An aluminum production plant, or an aluminum smelter, conventionally comprises several hundred electrolytic cells aligned transversely in parallel rows and connected in series.

An electrolysis current of the order of several hundred thousand Amperes passes through these electrolytic cells, and this creates a large magnetic field. The vertical component of this magnetic field, which is mainly produced by the linking conductors delivering current from one electrolytic cell to the next, is known to cause instabilities known as magnetohydrodynamic (MHD) instabilities.

These MHD instabilities are known to reduce the performance of the process. The more unstable the cell, the greater the interpolar distance between the anode and the layer of metal. Now, the greater the interpolar distance, the greater the energy consumption of the process because it is dissipated in the interpolar space by the Joule effect.

In addition to this, the horizontal component of the magnetic field, which is generated by all the flow of electric current in both the conductors within the cells and those outside, interacts with the electric current passing through the liquids, giving rise to stationary deformation of the metal layer. The irregularities produced in the metal layer level need to be sufficiently small for the anodes to be consumed uniformly with little wastage. In order to ensure that changes in level are small, the horizontal components of the magnetic field have to be as antisymmetric as possible in the liquids (the electrolyte bath and the layer of metal). In the case of the longitudinal or transverse component of the magnetic field comprising the horizontal components, antisymmetry is taken to mean that at a distance perpendicular from the central axis of the cell parallel to the component of the field in question, and at the same distance on either side of this central axis, the value of the component in question will be the opposite. The antisymmetry of the horizontal components of the magnetic field is the configuration bringing about the most symmetrical and the flattest possible deformation of the interface in the cell.

It is known, in particular from patent documents FR1079131 and FR2469475, that MHD instabilities can be controlled by compensating for the magnetic field created by passage of the electrolysis current using a particular arrangement of the conductors carrying the electrolysis current. For example, according to patent document FR2469475, the linking conductors pass laterally around the ends or heads of each electrolytic cell. This is known as self-compensation. This principle is based on local balancing out of the magnetic field on the scale of one electrolytic cell.

The main advantage of self-compensation lies in the use of the electrolysis current itself to compensate for MHD instabilities.

Nevertheless, self-compensation can give rise to a major space requirement at the sides because the electrical conductors pass around the heads of the electrolytic cells.

Above all the great length of the linking conductors implementing this solution gives rise to an in-line electrical loss through the resistance effect of the conductors, and therefore increased operating costs, and requires a great deal of raw material, and therefore high manufacturing costs. These disadvantages are even more marked where the electrolytic cells are of large size and operate at high current intensity.

Also the design of an aluminum smelter having a self-compensated electrical circuit is fixed. Over the course of its service life it may become necessary to increase the intensity of the electrolysis current beyond the intensity envisaged at the time of design. This will also in fact change the distribution of the magnetic field from the self-compensated electrical circuit, which has not been designed for this new distribution, as a result of which it will no longer optimally compensate for this magnetic field. There are solutions for overcoming this lack of development potential and recovering magnetic compensation which is close to optimum, but these solutions are particularly complex and costly to implement.

Another solution for reducing MHD instabilities, known in particular from patent document FR2425482, involves using a secondary electrical circuit or external loop along the sides of the rows of electrolytic cells. A current whose intensity is equal to a predetermined percentage of the intensity of the electrolysis current passes through this secondary electrical circuit. The external loop generates a magnetic field which compensates for the effects of the magnetic field created by the electrolysis current in the nearby row of electrolytic cells.

It is also known from patent document EP0204647 that a secondary circuit running along the sides of the rows of the electrolytic cells can be used to reduce the effect of the magnetic field created by the linking conductors, the intensity of the current passing through the electrical conductors in this secondary circuit being of the order of 5 to 80% of the intensity of the electrolysis current, the current flowing in the same direction as the electrolysis current.

The solution of providing compensation through an external loop has the advantage that it provides a secondary circuit independent of the main circuit through which the electrolysis current passes.

Positioning the secondary circuit along the sides of the rows of cells close to the smaller sides of the pot shells at the level of the bath-metal interface makes it possible to compensate for the vertical component without having any impact on the horizontal component of the magnetic field.

The solution of providing compensation through an external loop significantly reduces the length of the linking conductors, their mass and electrical losses, but requires an additional electricity power station and an additional independent secondary electrical circuit.

It will also be noted that the solution of providing compensation through an external loop implies an accumulation of magnetic fields, together with the series current, creating a very strong overall ambient field, to the extent that this gives rise to constraints on operations and equipment (for example, the shielding required for vehicles) and to the extent that the magnetic field from one row has an effect on the stability of the cells in the adjacent row. In order to reduce the influence of one row on the adjacent row, they must be separated from each other, and this is a major spatial constraint which consequently implies that each row of electrolytic cells must be housed within a separate hall.

In addition to this, the connecting portion between the electrolysis circuit and the secondary circuit connecting the ends of two adjacent rows of electrolytic cells tends to destabilize the cells at the end of a row. In order to avoid having unstable cells at the end of a row, this portion of the secondary circuit can be configured on the basis of a predetermined path, as is known from patent FR2868436, in order to correct the magnetic field so that its impact on the cells at the end of a row becomes acceptable. However this route appreciably increases the length of the secondary circuit, and therefore the material cost. It should be noted that the usual solution involves moving the junction portion between the secondary circuit and the electrolysis circuit of the cells located at the end of a row further away, but this increases the use of space as well as increasing the length of the electrical conductors, and therefore material and energy costs.

It is therefore apparent that known solutions for providing compensation through an external loop give rise to relatively major structural costs.

This invention, then, is intended to overcome these advantages either wholly or in part by providing an aluminum smelter with a magnetic configuration offering improved performance and a lesser use of space.

For this purpose this invention relates to an aluminum smelter comprising at least one row of electrolytic cells arranged transversely in relation to the length of the row, each of the electrolytic cells comprising a pot shell, anode assemblies comprising a support and at least one anode, and a cathode through which pass cathode conductors intended to collect the electrolysis current $I_1$ at the cathode and route it to cathode outputs outside the pot shell, characterized in that the electrolytic cell comprises rising and connecting electrical conductors connecting to the anode assemblies running upwards along the two opposite longitudinal edges of the electrolytic cell to route the electrolysis current $I_1$ to the anode assemblies, and linking conductors connected to the cathode outputs designed to route the electrolysis current from the cathode outputs to the rising and connecting electrical conductors of the next electrolytic cell, and in that the aluminum smelter comprises at least one compensating electrical circuit running beneath the electrolytic cells, through which compensating circuit may flow a compensating current $I_2$ flowing beneath the electrolytic cells in a direction opposite to the overall direction of flow of the electrolysis current $I_1$ flowing through the electrolytic cells located above.

The aluminum smelter according to the invention therefore uses up less space and offers the advantage that it can have cells which are magnetically very stable, to the extent that overall performance is improved.

According to one method of using this aluminum smelter, compensating current $I_2$ flows through the compensating circuit beneath the electrolytic cells in a direction opposite to the overall direction of flow of electrolysis current $I_1$ flowing through the electrolytic cells located above.

Advantageously the intensity of compensating current $I_2$ is of the order of 50% to 150% of the intensity of electrolysis current $I_1$.

The rising and connecting electrical conductors are arranged in the spaces between the cells, above the two longitudinal sides of the electrolytic cells on either side of the cell, to compensate for each other and achieve a substantially antisymmetrical distribution of the horizontal components of the magnetic field of the cell, ensuring that there is little change in the level of the aluminum layer, without having an impact on the vertical component of the magnetic field, so that the linking conductors, rising and connecting conductors, the electrical conductors between one cell and another giving rise to an unfavorable vertical and horizontal magnetic field which needs to be compensated for are in practice only the conductors from one cell to another running horizontally beneath the pot shell, i.e. more specifically the linking conductors. This unfavorable magnetic field is then compensated for by means of the compensating electrical circuit, through which advantageously a compensating current $I_2$ of the order of 50% to 150% of the intensity of electrolysis current $I_1$ may flow, flowing beneath the electrolytic cells in a direction opposite to the overall direction of flow of electrolysis current $I_1$ in the electrolytic cells located above.

The vertical component of the magnetic field in the cell can therefore be reduced or even virtually eliminated, and a substantially antisymmetrical horizontal magnetic field distribution can be maintained in the liquids. The proposed solution therefore makes it possible to obtain a cell with very little instability, and so improve performance, while maintaining the little change in level at the bath/metal interface which is also necessary for satisfactory functioning of the process.

The magnetic field is small, even almost cancelled out, close to the cells and the rows of cells and the aluminum smelter according to the invention, as a result of which the constraints on operation of the aluminum smelter and the equipment used in it associated with strong magnetic fields are eliminated. The magnetic field from one row therefore no longer affects the stability of the cells in the adjacent row, so that adjacent rows of cells can be placed closer together, and two adjacent rows of cells can in particular be located in one smaller building, to the extent that major savings in structural costs may be achieved when even only one compensating circuit is used.

Despite discouraging experience from the state of the art, the compensating circuit passes beneath the electrolytic cells and not along the sides of the row or rows of electrolytic cells. Space is therefore freed up on either side of the row or rows of electrolytic cells. As a result, freeing up space alongside each electrolytic cell, and more particularly the pot shell, can be envisaged, this being less expensive than raising them. The lack of need for an expensive heavy lifting solution offers major structural savings.

According to a preferred embodiment, the compensating electrical circuit is a secondary compensating electrical circuit separate from the electrical circuit through which the electrolysis current $I_1$ flows. "Separate", is taken to mean that the two circuits are not electrically connected.

Should one of the electrolytic cells be breached by the liquids present in one of the electrolytic cells, whose temperature is close to 1,000° C., the compensating circuit will be damaged and severed or will be unable to operate normally, affecting performance, because the compensating circuit will no longer be able to compensate for the magnetic field generated by the flow of the electrolysis current, and the aluminum smelter will continue to operate in degraded mode with poorer performance, without undergoing a harmful shutdown, because the current flowing in the compensating circuit is intended to be used only to compensate for the magnetic field and not for the production of aluminum.

The use of a separate secondary compensating electrical circuit also offers the possibility of modifying the compensating magnetic field created by this compensating circuit over the course of time. To do this, the intensity of the current flowing in the secondary compensating electrical circuit must be varied. This is of essential importance in terms of upgradability and adaptability. Partly because if the intensity of the electrolysis current is increased during the lifetime of the aluminum smelter, the magnetic compensation can be adjusted to this change by varying the intensity of the compensating current as necessary. Also because the intensity of the compensating current can be adjusted to the characteristics and quality of the alumina available. In this way the velocities of MHD flows can be controlled to encourage or reduce stirring of the liquids and dissolution of alumina in the bath on the basis of the characteristics of the alumina available, which ultimately helps to provide the best possible performance in the light of alumina supplies.

The secondary compensating electrical circuit may more particularly be powered by its own electricity power station, different from the station providing electrolysis current to the electrolytic cells.

In a preferred embodiment the aluminum smelter comprises two rows of cells arranged in parallel with each other, powered by a single station and electrically connected in series so that the electrolysis current flowing in the first two rows of cells then flows in the second of the two rows of cells in a direction which is overall opposite to that in which it was flowing in the first of the two rows, and in that the compensating electrical circuit forms a loop beneath these two parallel rows of cells.

This means that two adjacent rows of electrolytic cells can be moved closer to place them in the same building, in view of the magnetic compensation which is achieved simultaneously by means of the compensating circuit and the linking conductors, through which opposite electrical currents pass. Finally, what is gained in terms of space and structural costs is more than what is lost in the cost of constructing and operating the compensating circuit.

As the secondary compensating electrical circuit forms a loop beneath the cells, it becomes advantageous to use an electrical conductor of a superconducting material in order to construct it, and it is above all possible to make several turns in series, as described in patent application WO2013007893 in the name of the applicant.

Advantageously, the electrolytic cell comprises a plurality of rising and connecting electrical conductors along each of its two longitudinal edges positioned at predetermined intervals over substantially the entire length of the corresponding longitudinal edge.

On each longitudinal edge, rising and connecting conductors may be positioned at regular intervals along the longitudinal direction of the electrolytic cell.

The equilibrium of the longitudinal horizontal component of the magnetic field (i.e. that parallel to the length of the cell) can be improved in this way.

A cell operating with a current intensity of 400 to 1,000 k Amperes may for example preferably comprise 4 to 40 rising and connecting conductors regularly spaced over the entire length of each of its two longitudinal edges.

The upstream rising and connecting electrical conductors and the downstream rising and connecting electrical conductors may be located equidistant from a longitudinal median plane of the electrolytic cell, i.e. a plane substantially perpendicular to a transverse direction of the cell and separating it into two substantially equal parts.

By upstream rising and connecting electrical conductor and downstream rising and connecting electrical conductor are meant the rising and connecting electrical conductors respectively located alongside the upstream or downstream longitudinal edge of the electrolytic cell, the upstream longitudinal edge corresponding to that closest to the start of the row of electrolytic cells, and the downstream longitudinal edge corresponding to the longitudinal edge of the electrolytic cell furthest from the start of the row of electrolytic cells, having regard to the overall direction of the flow of electrical current on the scale of the row of electrolytic cells.

According to a preferred embodiment, the rising and connecting electrical conductors are located in a substantially symmetrical way in relation to a median longitudinal plane of the electrolytic cell.

In other words, the rising and connecting electrical conductors extending along one of the two longitudinal edges of the electrolytic cell are located in a substantially symmetrical way in relation to the rising and connecting electrical conductors running along the opposite longitudinal edge of the electrolytic cell in relation to a longitudinal median plane of the electrolytic cell, i.e. a plane substantially perpendicular to a transverse direction of the cell and separating it into two substantially equal parts.

The advantageous substantially antisymmetrical characteristic of the distribution of the horizontal magnetic field in the liquids is therefore further improved.

According to a preferred method of use, the distribution of current between the rising and connecting electrical conductors located upstream of the electrolytic cell and the rising and connecting electrical conductors located downstream of the electrolytic cell is of the order of 30-70% upstream and 30-70% downstream respectively, preferably 40-60% upstream and 40-60% downstream respectively.

This method of use makes it possible to improve the advantageous substantially antisymmetrical characteristic of the distribution of the horizontal magnetic field in the liquids. The distribution of current between the rising and connecting electrical conductors located upstream of the electrolytic cell and the rising and connecting electrical conductors located downstream of the electrolytic cell is preferably of the order of 45-55% upstream and 45-55% downstream respectively.

The advantageous substantially antisymmetrical characteristic of the distribution of the horizontal magnetic field in the liquids is therefore further improved.

In a preferred embodiment, the connecting conductors run beneath the electrolytic cell in a substantially straight line, and only in a transverse direction in relation to the electrolytic cell.

The length and cost of the electrical conductors is therefore reduced by minimizing the length of the conductors running in the longitudinal direction of the cell. The magnetic fields generated by these longitudinal electrical conductors in the embodiments in the prior art are also reduced, particularly as regards self-compensated cells. In addition to this, space is freed up on either side of the row or rows of electrolytic cells, which reduces at least the longitudinal footprint of the set of cells/electrical conductors and makes it possible to envisage opening up space alongside each electrolytic cell and more particularly the pot shell, which is less expensive than raising them.

The compensating electrical circuit may comprise electrical conductors running substantially parallel to a transverse axis of the electrolytic cells.

According to one embodiment, the compensating electrical circuit comprises electrical conductors forming a plurality of secondary compensating electrical sub-circuits which are independent of each other.

A compensating current of intensity which can vary independently of the intensity of the electrolysis current flows through each of these secondary compensating electrical sub-circuits.

By independent secondary compensating electrical sub-circuits are meant sub-circuits which are not electrically connected to other secondary compensating electrical sub-circuits, and which can be powered by a power station which is separate from that for the other secondary compensating electrical sub-circuits.

Should any problems arise, therefore, for example through the breaching of a cell, giving rise to damage to it and/or severing one or more secondary compensating electrical sub-circuits, this offers the possibility of continuing production in a "degraded" operating mode in which the intensity of the compensating current flowing through each of the other undamaged secondary compensating electrical sub-circuits is adjusted to compensate for the magnetic field created by the flow of electrolysis current. Performance can therefore remain high despite possible malfunction of one of the secondary compensating electrical sub-circuits.

The compensating electrical circuit may comprise electrical conductors forming several turns in parallel and/or in series beneath the electrolytic cells.

According to one possibility the compensating electrical circuit comprises electrical conductors running in parallel beneath the electrolytic cells.

The electrical conductors of the compensating electrical circuit may be arranged substantially symmetrically in relation to a transverse median plane of the electrolytic cells, that is a plane substantially perpendicular to a longitudinal direction of the electrolytic cells and separating the cells into two substantially equal parts.

According to one possibility, the electrical conductors forming the compensating electrical circuit or, if appropriate, the secondary compensating electrical sub-circuits run beneath the electrolytic cells, together forming a layer of between two and twelve and preferably between three and ten parallel electrical conductors.

Advantageously, said electrical conductors are substantially equidistant and located substantially symmetrically in relation to a transverse median axis of the electrolytic cells.

Compensation for the unfavorable magnetic field is therefore further improved.

The principle of magnetic compensation or balancing in the aluminum smelter and the method of using the aluminum smelter according to the invention makes it possible to achieve a circuit of conductors for the aluminum smelter which can be constructed in a completely modular way. Every module may for example comprise one electrical conductor of the compensating electrical circuit and a particular number of linking conductors and rising and connecting conductors associated with each electrolytic cell. The circuit of conductors, and therefore each cell, may comprise a particular number of modules, determining the length of the cells and the intensity of the current passing through the cells. The number of modules chosen per cell at the time of design or the length of the cells chosen through the addition of such modules does not disturb the magnetic equilibrium of the cells, unlike elongation of cells of the self-compensated type or those compensated by magnetic compensating circuits arranged along the sides of the cells known in the prior art, for which the conducting circuits need to be completely redesigned. The ratio of the quantity of material forming the circuit of conductors to the production surface area of the cells is therefore not worsened when the cells are lengthened; it increases in proportion to the number of modules and the current intensity passing through the cells. The cells can therefore be extended simply in relation to need, and the intensity of the current passing through them is not restricted. It then becomes possible to increase the intensity of the current passing through the cells above 1,000 k Ampere, up to even 2,000 k Ampere.

According to one embodiment the rising and connecting electrical conductors running alone one of the two longitudinal edges of the electrolytic cell are in a staggered arrangement in relation to the rising and connecting electrical conductors located on the adjacent longitudinal edge of a preceding or subsequent separate electrolytic cell.

In other words, the upstream rising and connecting electrical conductors of an electrolytic cell N are in a staggered arrangement in relation to the upstream rising and connecting electrical conductors of electrolytic cell N−1, i.e. the preceding electrolytic cell.

This also makes it possible to bring the electrolytic cells as close as possible to each other, either to have more electrolytic cells in series over a same distance, which increases performance, or to reduce the length of a row of electrolytic cells, and thus gain space and make even more structural savings.

According to a preferred method of use of the aluminum smelter according to the invention, compensating current of an intensity of the order of 70% to 130% of the intensity of the electrolysis current $I_1$, and preferably of the order of 80% to 120% of the intensity of the electrolysis current $I_1$, passes through the compensating electrical circuit.

So if the aluminum smelter comprises a compensating electrical circuit formed by an electrical conductor making a single turn beneath the electrolytic cells, the intensity of the compensating current flowing through this compensating circuit may be of the order of 70% to 130% of the intensity of the electrolysis current.

Also if the aluminum smelter comprises a compensating electrical circuit formed by an electrical conductor of superconducting material making three turns in series beneath the electrolytic cells, the intensity of the compensating current flowing through the electrical conductor may be of the order of one third of 70% to 130% of the intensity of the electrolysis current.

According to another example, if the compensating electrical circuit is formed by three secondary compensating electrical sub-circuits each making twenty turns in series and each comprising electrical conductors of superconducting material, the intensity of the compensating current flowing through each of the three secondary compensating electrical sub-circuits may be of the order of one sixtieth of 70% to 130% of the intensity of the electrolysis current.

According to one embodiment, each cathode output leaves the pot shell only in a vertical plane perpendicular to the longitudinal direction of the electrolytic cell.

The cathode outputs pass through the base of the pot shell of the electrolytic cell. The fact that the cathode outputs are located at the base of the electrolytic cell, instead of passing out through its sides, reduces the length of the linking conductors, and therefore the horizontal currents in the liquids, with the effect of better MHD stability.

The linking electrical conductors may run in a straight line, substantially parallel to a transverse direction of the electrolytic cell, towards the rising and connecting electrical conductors of the next electrolytic cell.

As indicated above, the principle of magnetic compensation or balancing of the aluminum smelter and the method of using the aluminum smelter according to the invention makes it possible to increase the intensity of the current passing through the electrolytic cells in relation to need, without any magnetohydrodynamic problems, by lengthening the electrolytic cells. Now an electrolytic cell according to the state of the art comprises a superstructure crossing the electrolytic cell longitudinally above the pot shell and the anodes. The superstructure in particular comprises a beam resting on feet at each of its longitudinal ends. It supports an anode frame, which also extends longitudinally above the pot shell and the anodes, supporting the anode assemblies and to which the anode assemblies are connected. Lengthening of an electrolytic cell according to the state of the art thus results in lengthening of the superstructure, and therefore the span of the beam between the feet supporting the beam and increases the weight which has to be supported by that superstructure. Limited lengthening of the superstructure of an electrolytic cell according to the state of the art thus limits the possibilities offered by the principle of magnetic compensation or balancing of the aluminum smelter and the method of using the aluminum smelter according to the invention. Known superstructures comprise one or more intermediate arches supporting the beam, but such intermediate arches extending transversely above the pot shell and the anodes are bulky and render operations on the cells, in particular the changing of anodes, complex.

According to one particularly advantageous embodiment of the invention the support for the anode assembly comprises a cross-member extending transversely in relation to the electrolytic cell and supported and electrically connected at each of the two longitudinal edges on either side of the electrolytic cell.

Electrical connection between the rising and connecting conductors and the anode assembly is therefore made on the longitudinal edges of the electrolytic cell, and it is here that the anode assembly is mechanically supported.

The anode assembly is no longer supported and electrically connected by means of a superstructure passing longitudinally over the electrolytic cell above the pot shell and the anodes, in such a way that the electrolytic cells can be lengthened to take full advantage of the possibilities offered by the principle of magnetic compensation or balancing in the method of using the aluminum smelter according to the invention.

According to another embodiment, the rising and connecting conductors run on either side of the pot shell, without running above the anode or anodes.

"Above the anode or anodes" is taken to mean within a volume formed by the vertical translation of the surface obtained by projection of the anode or anodes in a horizontal plane XY.

Such an embodiment advantageously allows the anode to be replaced by moving it vertically upwards, because an anode which has been moved vertically upwards does not encounter any components used to connect it. Savings in management and operation of the aluminum smelter according to the invention also derive from this simplification in positioning and withdrawing the anode.

The length of the rising and connecting conductors is therefore reduced in relation to the use of rising and connecting conductors of the conventional type, which typically extend above the cell as far as the central longitudinal part of the cell. This helps to reduce manufacturing costs.

The rising and connecting conductors are more particularly connected to anode assemblies above the edges of a pot shell.

"Above the sides of a pot shell" is taken to mean within a volume formed by the vertical translation of the surface obtained by projection of the edges of the pot shell in a horizontal plane XY.

Advantageously, the rising and connecting electrical conductors extend to a height h of between 0 and 1.5 meters above a substantially horizontal plane which includes the surface of the liquids present in the electrolytic cell.

The length of these rising and connecting conductors is thus greatly decreased in relation to the rising and connecting conductors of a conventional type which extend to heights of more than two meters.

The invention also relates to a process for stirring the alumina present in the electrolytic cells of an aluminum smelter having the above mentioned characteristics, the process comprising:

analyzing of at least one characteristic of the alumina, determining a value for the intensity of the compensating current which has to flow in the compensating electrical circuit in relation to the said at least one characteristic analyzed, changing the intensity of the compensating current $I_2$ to the intensity value determined in the previous stage, if the intensity of the compensating current $I_2$ differs from that value.

The process according to the invention therefore makes it possible to change the magnetic compensation, by increasing or decreasing the intensity of compensating current $I_2$, in order to induce controlled MHD instabilities, these instabilities helping to stir the alumina for a better performance. Such a process is particularly useful with the configuration of the electrical conductors described above, which makes the cells magnetically very stable.

The analyzed characteristics of the alumina may in particular be the ability of the alumina to dissolve in the bath, the fluidity of the alumina, its solubility, its fluorine content, its moisture content, etc.

A desired value of the intensity of the compensating current can be determined in relation to the analyzed characteristics of the alumina through the use of a nomograph, for example, produced by a person skilled in the art through experiment and recording of optimum correspondences between compensating current $I_2$ and the characteristics of the alumina. Here it is a matter of quantifying the desired MHD instabilities.

It may happen that the alumina available for continuous operation of the aluminum smelter is of different quality, in particular more or less pasty, and thus has different abilities to dissolve in the electrolysis bath. In this case, movement of the liquids in the electrolytic cells is an advantage because it can be used to stir this alumina to encourage it to dissolve. Now in the case of self-compensation in particular the magnetic field giving rise to movement of the liquids is directly compensated for by the electrolysis current itself, with a distribution of the magnetic field imposed and fixed by the path of the linking conductors. In aluminum smelters where there is self-compensation it is therefore not possible to introduce a deliberate and temporary imbalance in the compensation for the magnetic field to increase the intensity with which the alumina is stirred in the cells with a view to increasing the efficiency of dissolution. So when the only alumina available is alumina which has greater than normal difficulty in dissolving, the performance of aluminum smelters with self-compensation may be substantially affected.

Figure 2:
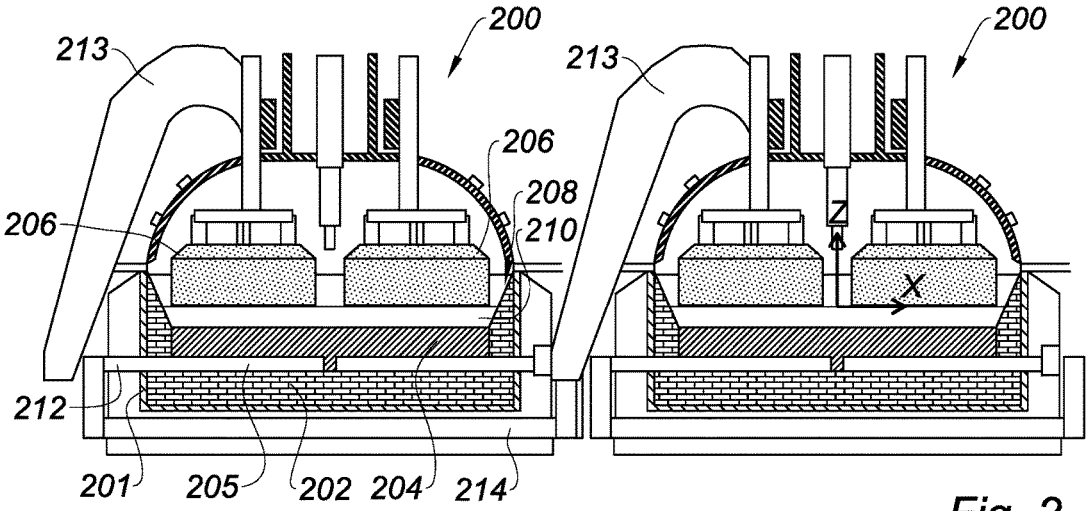
Figure 3:
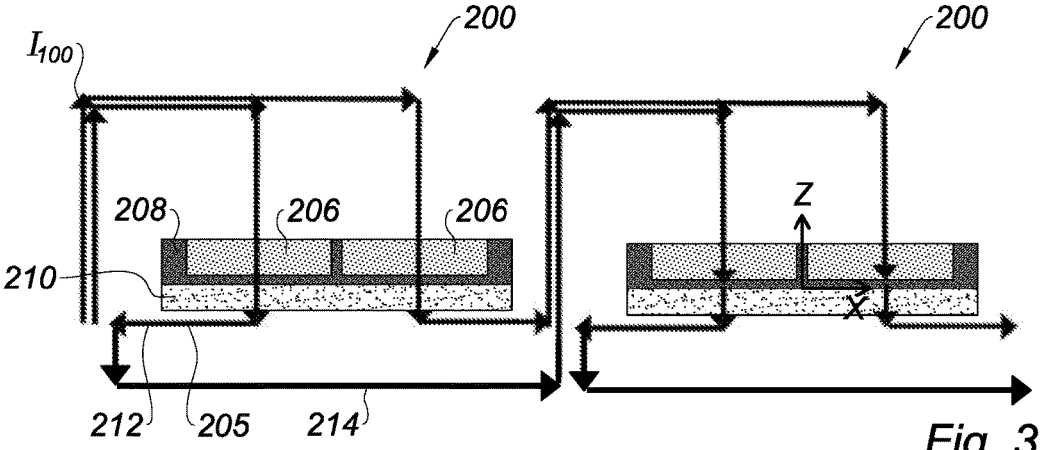
Figure 4:
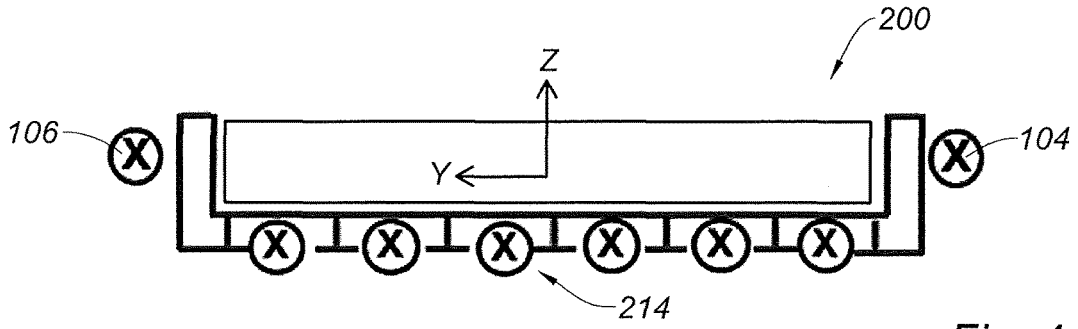
Figure 5:
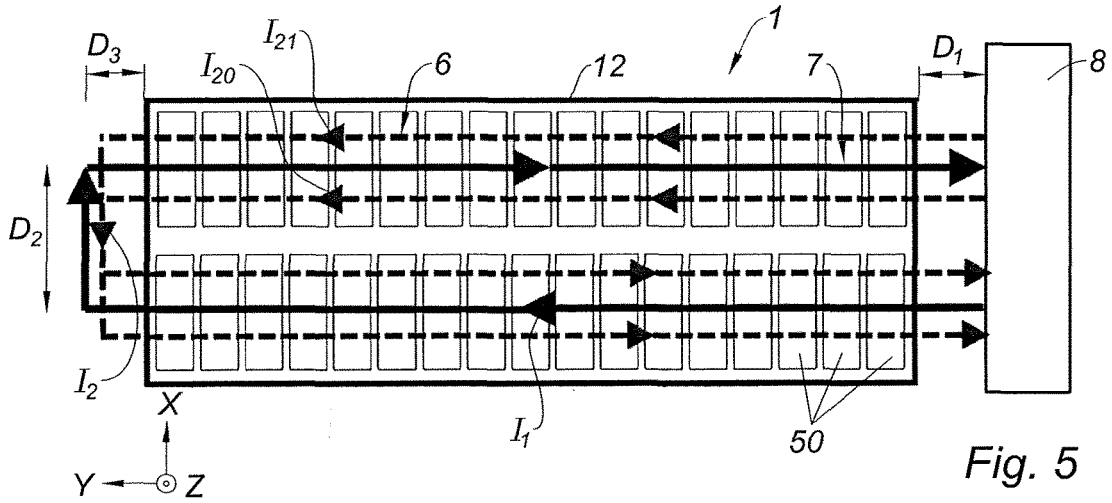
Figure 6:
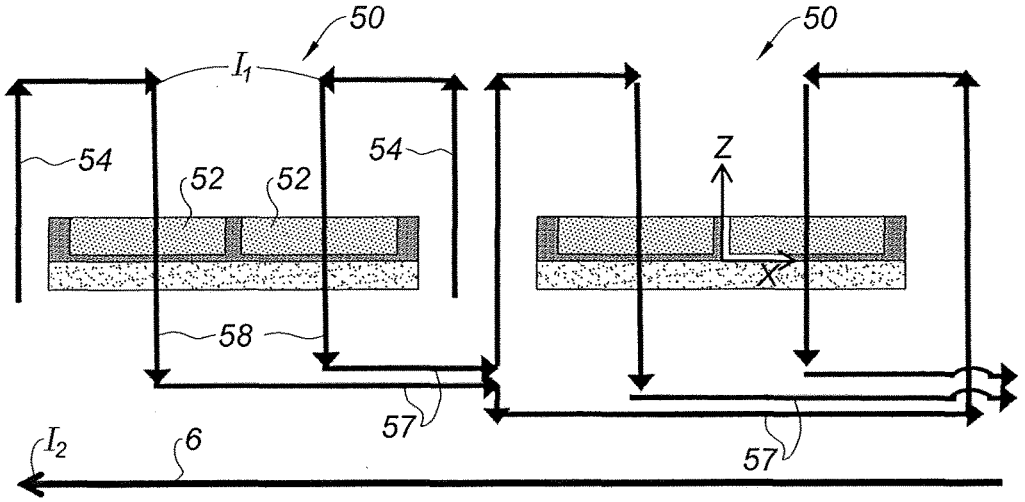
Figure 7:
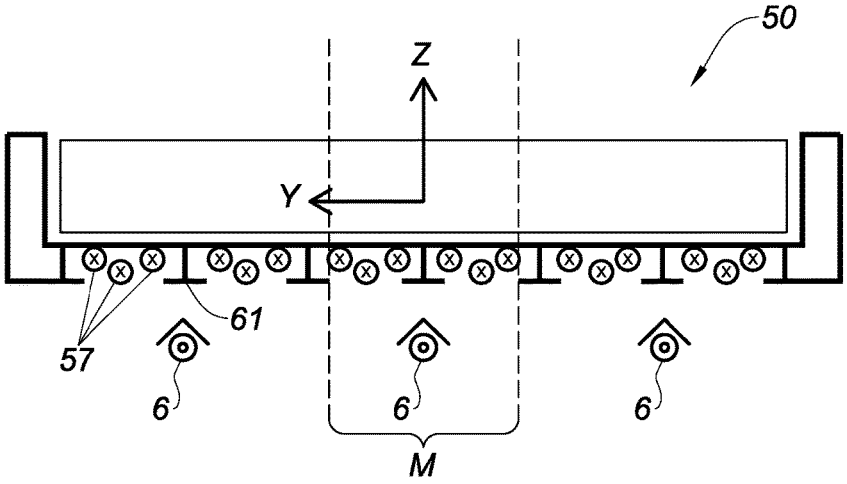
Figure 9:
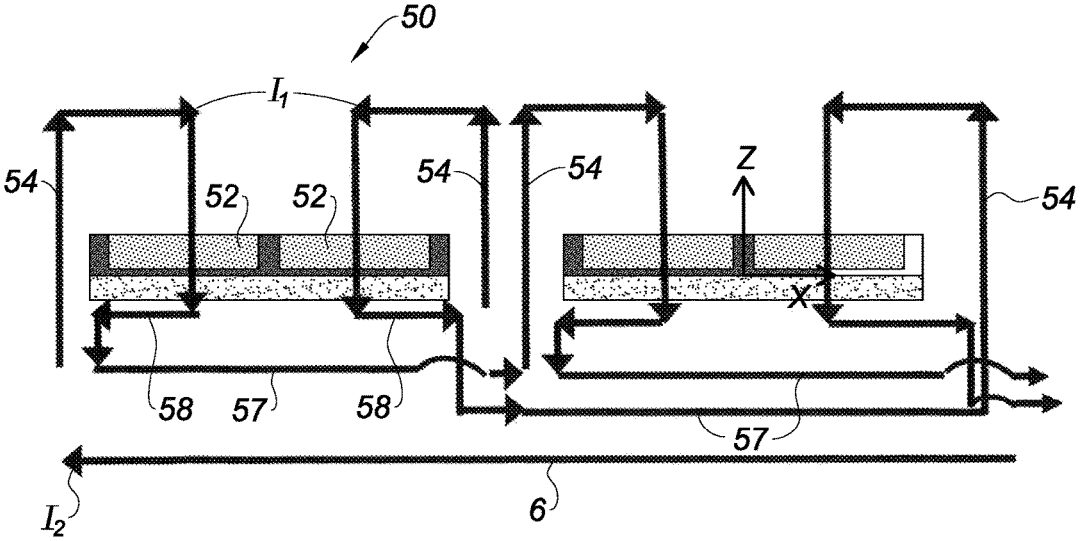
Figure 8:
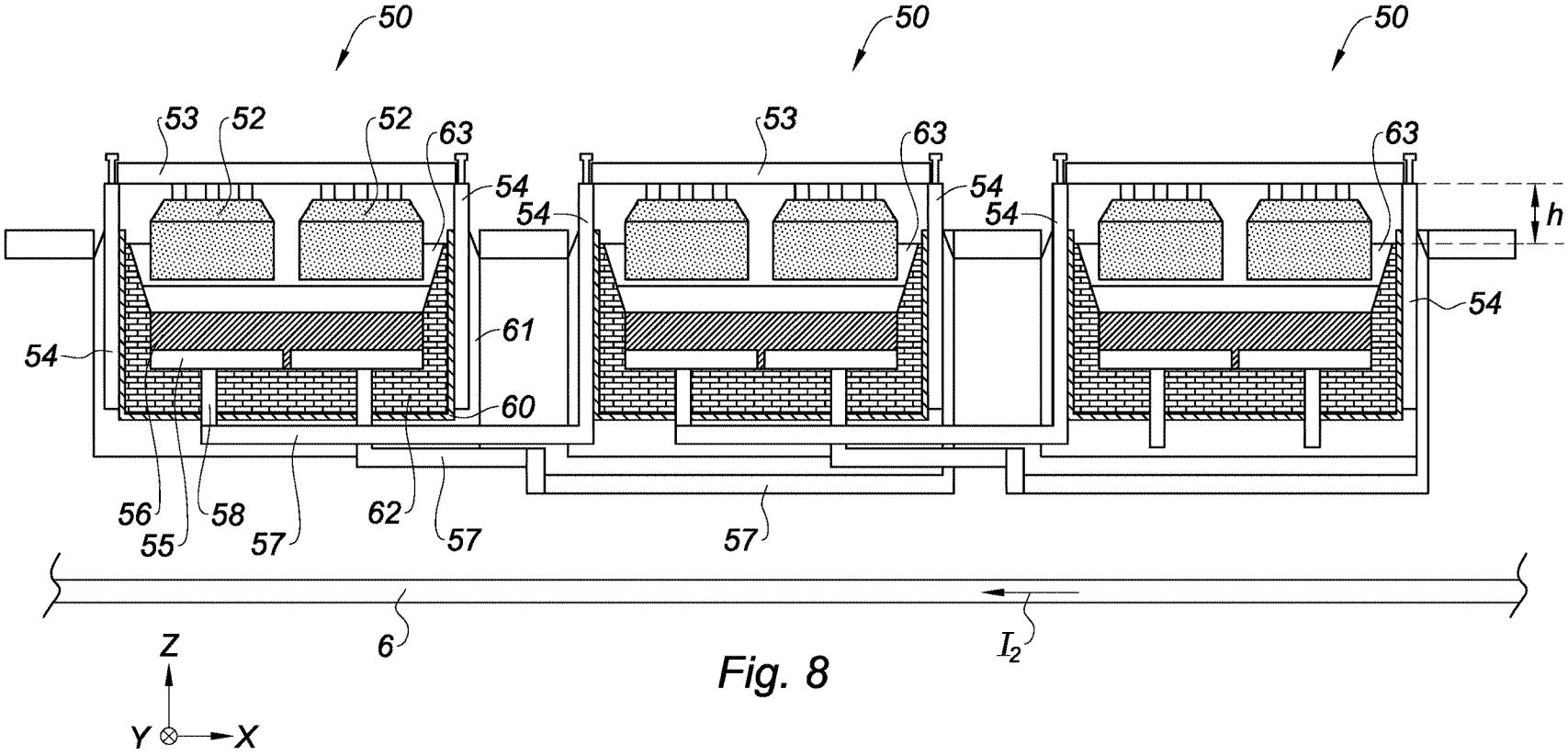

Other characteristics and advantages of this invention will be clearly apparent from the following description of a particular embodiment provided by way of a non-limiting example with reference to the appended drawings, in which:

FIG. 1 is a schematic view of an aluminum smelter according to the state of the art, FIG. 2 is a schematic view from the side of two successive electrolytic cells according to the state of the art, FIG. 3 is a line diagram of the electrical circuit through which the electrolysis current flows in the two cells in FIG. 2, FIG. 4 is a schematic view in cross-section along a longitudinal vertical plane of an electrolytic cell according to the state of the art, FIG. 5 is a schematic view of an aluminum smelter according to one embodiment of the invention, FIG. 6 is a line diagram of the electrical circuit through which the electrolysis current flows in two successive cells in an aluminum smelter according to the invention, FIG. 7 is a view in cross-section along a vertical longitudinal plane of an electrolytic cell in an aluminum smelter according to one embodiment of the invention, FIG. 8 is a schematic view from the side of three successive electrolytic cells in a row of electrolytic cells in an aluminum smelter according to one embodiment of the invention, FIG. 9 is a line diagram of the electrical circuit through which the electrolysis current flows in two successive cells in an aluminum smelter according to the invention, FIG. 1 shows an aluminum smelter 100 according to the state of the art. Aluminum smelter 100 comprises electrolytic cells arranged transversely in relation to the length of the row which they form. Here the cells are aligned in two parallel rows 101, 102, and an electrolysis current $I_{100}$ passes through them. Two secondary electrical circuits 104, 106, run along the sides of rows 101, 102 to compensate for the magnetic field generated by the flow of electrolysis current $I_{100}$ from one cell to another and in the adjacent row. Currents $I_{104}$, $I_{106}$ flowing in the same direction as the electrolysis current $I_{100}$ flow through circuits 104, 106 respectively. Power stations 108 provide power to the series of electrolytic cells and secondary electrical circuits 104, 106. According to this example, for an electrolysis current of intensity 500 kA, taking into account "end-of-row" magnetic disturbances, the distance $D_{100}$ between the electrolytic cells closest to power stations 108 and power stations 108 is of the order of 45 m, and the distance $D_{300}$ over which secondary electrical circuits 104, 106 extend beyond the ends of the row, is of the order of 45 m, while the distance $D_{200}$ between the two rows 101, 102 is of the order of 85 m in order to limit magnetic disturbances between one row and another.

It is pointed out that the description is provided in relation to a Cartesian frame of reference relating to an electrolytic cell, the X axis being orientated in a transverse direction of the electrolytic cell, the Y axis being orientated in a longitudinal direction of the electrolytic cell and the Z axis being orientated in a vertical direction of the electrolytic cell. Longitudinal, vertical and transverse orientations, directions, plans and movements are defined relative to this standard.

FIG. 2 shows two consecutive conventional electrolytic cells 200 in one row of cells. As shown in FIG. 2, electrolytic cell 200 comprises a pot shell 201 lined internally with refractory materials 202, a cathode 204 and anodes 206 immersed in an electrolyte bath 208, at the bottom of which a layer 210 of aluminum forms. Cathode 204 is electrically connected to cathode conductors 205 which pass through the sides of pot shell 201 at the level of cathode outputs 212. Cathode outputs 212 are connected to linking conductors 214 which route the electrolysis current to the rising and connecting conductors 213 of the next electrolytic cell. As shown in FIG. 2, these rising and connecting conductors 213 extend along a single side, the upstream side, of electrolytic cell 200 and then above anodes 206 as far as the central longitudinal part of the cell.

FIG. 3 schematically illustrates the path travelled by electrolysis current $I_{100}$ in each of cells 200 and between two adjacent cells, as shown in FIG. 2. It will in particular be noted that the electrolysis current $I_{100}$ rises up to the anode assembly of a cell asymmetrically because this rise takes place only upstream of the cells in the overall direction of flow of electrolysis current $I_{100}$ within the row (to the left of the cells in FIGS. 2 and 3).

FIG. 4 shows a cross-sectional view of a conventional cell 200, in which it will be seen that electrical conductors forming secondary electrical circuits 104, 106, to compensate for the magnetic field generated by the flow of electrolysis current $I_{100}$ from one cell 200 to another and in the adjacent row are located on the sides of cell 200.

FIG. 5 shows an aluminum smelter 1 according to one embodiment of the invention. Aluminum smelter 1 comprises a plurality of electrolytic cells 50, which are substantially rectangular and are intended to produce aluminum by electrolysis, which can be aligned in one or more rows, in the case in point, two substantially parallel rows, connected in series, supplied with an electrolysis current $I_1$.

It is important to note that electrolytic cells 50 are arranged transversely in relation to the row which they form. It will be noted that by a transversely arranged electrolytic cell 50, is meant an electrolytic cell 50 whose largest dimension, its length, is substantially perpendicular to the overall direction in which electrolysis current $I_1$ flows, that is the direction in which electrolysis current $I_1$ flows in the scale of the row in electrolytic cells 50.

Aluminum smelter 1 also comprises a compensating electrical circuit 6 through which a compensating current $I_2$ flows. Unlike circuits 104, 106, illustrated in FIG. 1, it is important to note that compensating electrical circuit 6 runs beneath electrolytic cells 50. It will also be noted that compensating current $I_2$ flows in the opposite direction to electrolysis current $I_1$. Compensating electrical circuit 6 in FIG. 5 more particularly forms a loop beneath the rows of electrolytic cells 50.

Advantageously a set of power stations 8 independently powers electrolytic cells 50 and compensating electrical circuit 6. In other words, compensating electrical circuit 6 is a secondary compensating electrical circuit which is separate from main electrical circuit 7 through which electrolysis current $I_1$ flows.

The intensity of compensating current $I_2$ varies independently of electrolysis current $I_1$. The intensity of compensating current $I_2$ can therefore be changed without the intensity of electrolysis current $I_1$ necessarily being changed.

FIG. 8 shows three consecutive electrolytic cells 50 in aluminum smelter 1. Conventionally electrolytic cells 50 comprise a pot shell 60, fitted with reinforcing cradles 61, which may be of metal, for example steel, and an inner lining 62 of refractory materials.

Electrolytic cells 50 comprise a plurality of anode assemblies comprising a support 53 (here a transverse horizontal bar) and at least one anode 52, in particular made of carbon material, and more particularly of the pre-baked type, rising and connecting conductors 54 which, unlike electrolytic cell 200, run on either side of each of electrolytic cells 50 to route electrolysis current $I_1$ towards anodes 52 and a cathode 56, which may be formed of several cathode blocks made of carbon material, through which cathode conductors 55 pass in order to collect electrolysis current $I_1$ to route it to cathode outputs 58 which pass through the base of pot shell 60 and are connected to linking conductors 57, which in turn carry the electrolysis current to rising and connecting conductors 54 of the next electrolytic cell 50. The anode assemblies are designed to be removed and replaced periodically as the anodes wear out.

Cathode conductors 55, cathode outputs 58 and linking conductors 57, may take the form of metal bars, made, for example of aluminum, copper and/or steel.

FIG. 6 schematically shows the path of electrolysis current $I_1$ in two successive electrolytic cells 50 in aluminum smelter 1 according to the invention. By comparison with FIG. 3 it will easily be seen that here electrolysis current $I_1$ advantageously rises along the two longitudinal sides of electrolytic cell 50. The presence of compensating circuit 6 beneath electrolytic cells 50, through which compensating current $I_2$ flows in a direction opposite to the overall direction of electrolysis current $I_1$ from one cell 50 to the next, will also be noted.

FIG. 9 shows schematically the path of electrolysis current $I_1$ in two successive electrolytic cells 50 of aluminum smelter 1 according to the invention, and differs from FIG. 6 in that cathode outputs 58 leave pot shell 60 in a more conventional way at the sides of pot shell 60.

FIG. 7 shows a cross-sectional view of an electrolytic cell 50 in aluminum smelter 1. The presence of compensating circuit 6 beneath electrolytic cells 50, through which compensating current $I_2$ flows in a direction opposite to the overall direction of electrolysis current $I_1$ from one cell 50 to the next, will also be noted.

It will also be noted that according to the example in FIG. 7 compensating circuit 6 forms a layer of three substantially equally spaced conductors located in the same substantially horizontal plane XY; furthermore the conductors in this layer may run substantially symmetrically in relation to a transverse median plane XZ.

The circuit of electrical conductors for the cell and the aluminum smelter may advantageously be constructed in a modular fashion. FIG. 7 in particular shows a cell formed of three identical modules M. In this example each module comprises linking conductors 57 located between three adjacent cradles 61 of the pot shell and a conductor for compensating circuit 6 substantially located beneath central cradle 61 of the module. A current of the order of 50% to 150% of the intensity of the electrolysis current corresponding to the module passes through the conductor of compensating circuit 6 of the module. As the magnetic stability of the cell is provided on a module by module basis, the stability of the cell does not depend on the number of modules forming the circuit of electrical conductors for the cell and the aluminum smelter. The length and current intensity of the cells may therefore be adjusted simply by adding modules in order to satisfy the desired conditions for construction of the aluminum smelter.

As shown in FIG. 8, rising and connecting conductors 54 run upwards, for example substantially vertically, along each longitudinal edge of electrolytic cells 50. The longitudinal edges of electrolytic cells 50 correspond to the edges having the largest dimension, substantially perpendicular to the transverse direction X.

Upstream rising and connecting conductors 54 and those downstream may also be arranged equidistantly from a median plane YZ of electrolytic cell 50.

Upstream rising and connecting conductors 54 may be substantially symmetrical to downstream linking electrical conductors 54 in relation to the median plane YZ of electrolytic cells 50.

Although not shown, upstream rising and connecting conductors 54 of one of electrolytic cells 50 may be in a staggered arrangement in relation to downstream rising and connecting conductors 54 of the preceding electrolytic cell 50 in the row.

FIG. 8 also shows that rising and connecting conductors 54 run on either side of pot shell 60 without running above anodes 52, i.e. without running within a volume projected vertically from the surface area of the anodes in a horizontal plane.

It will be also noted that rising and connecting electrical conductors 54 run above liquids 63 at a height h of between 0 and 1.5 meters.

Furthermore support 53 for the anode assembly comprises a cross-member extending transversely in relation to electrolytic cell 50, supported and electrically connected at each of the two longitudinal edges on either side of electrolytic cell 50.

It will be noted that the distribution of electrolysis current $I_1$ between upstream rising and connecting conductors 54 of electrolytic cells 50 and downstream rising and connecting conductors 54 of electrolytic cells 50 may for example be of the order of 30% to 70% upstream, and 70% to 30% downstream respectively. Advantageously, this current distribution is 40% to 60% upstream and 60% to 40% downstream respectively, and preferably 45% to 55% upstream and 55% to 45% downstream respectively. In other words it is of the order of 50% plus or minus 20% upstream and the remainder downstream, preferably of the order of 50% plus or minus 10%, and even more preferably of the order of 50% plus or minus 5%.

As shown in FIG. 8, cathode outputs 58 and linking conductors 57 may run only in a vertical plane XZ perpendicular to the longitudinal direction Y of electrolytic cells 50. In particular cathode outputs 58 may extend only substantially vertically.

Cathode outputs 58 may pass through the base of pot shell 60 of electrolytic cells 50 and linking conductors 57 may run between electrolytic cells 50 advantageously in a straight line substantially parallel to a transverse direction X of electrolytic cells 50 towards rising and connecting conductors 54 of the next electrolytic cell 50.

The association of a compensating electrical circuit 6 passing beneath electrolytic cells 50, whose compensating current $I_2$ flows in a direction opposite to the electrical current $I_1$, and rising and connecting conductors 54 extending on the two opposite longitudinal edges of electrolytic cells 50 makes it possible to stabilize the liquids present in electrolytic cells 50 and to limit disturbances in electrolytic cells 50 at the end of a row because the magnetic fields generated by the electrical current conductors passing beneath the cells and the compensating electrical circuit conductors cancel each other out.

The intensity of the compensating current flowing through the compensating circuit is advantageously of the order of 50% to 150% of the intensity of electrical current $I_1$, preferably of the order of 70% to 130% of the intensity of electrolysis current $I_1$, and even more preferably of the order of 80% to 120% of the intensity of electrolysis current $I_1$, in order to ensure that the magnetic fields are appropriately cancelled out and stability of the cells is ensured.

As a consequence, the distances between rows and the lengths of the electrolysis and compensating electrical circuit 6 may be reduced. Also, referring again to FIG. 5, distance $D_1$ between electrolytic cells 50 closest to power stations 8 and/or distance $D_3$ over which compensating electrical circuit 6 extends beyond the ends of a row is less than or equal to 30 m, for example less than or equal to 20 m, and preferably less than or equal to 10 m; the distance $D_2$ between two rows is less than or equal to 40 m; for example less than or equal to 30 m, and preferably less than or equal to 25 m. As shown in FIG. 5, the two rows in aluminum smelter 1 according to the invention may therefore be located in the same building 12, which makes very major structural savings possible.

Preferably, compensating electrical circuit 6 extends beneath cells 50 forming a layer of between two and twelve, and preferably between three and ten parallel electrical conductors which are substantially equally spaced and distributed substantially symmetrically in relation to a transverse median axis X of cells 50. Compensating current $I_2$ passing for example in an equally distributed manner through the conductors of this layer of parallel conductors is therefore better distributed beneath the entire length of cell 50. The magnetic fields generated by linking conductors 57 through which electrolysis current $I_1$ passes, which themselves are distributed beneath cell 50 over its entire length, are also better compensated for.

The electrical conductor or conductors forming compensating electrical circuit 6 run beneath rows of cells 50 in a manner substantially parallel to a transverse axis X of electrolytic cells 50.

It will be noted that compensating circuit 6 may be formed by electrical conductors forming a plurality of secondary compensating electrical sub-circuits which are independent of each other, through each of which there flows a compensating current flowing in a direction contrary to electrolysis current $I_1$. The secondary compensating electrical sub-circuits may form parallel loops beneath electrolytic cells 50, for example two in the case of FIG. 5. So if an electrolytic cell 50 should be breached, and if one of its sub-circuits is affected, the or the other secondary compensating electrical sub-circuits may continue to compensate for the magnetic field.

Furthermore, the electrical conductors of compensating circuit 6, or if applicable of one of the secondary compensating electrical sub-circuits, may make several turns in parallel and/or in series beneath the electrolytic cells, particularly when these electrical conductors are made of superconducting material.

Electrical conductors forming compensating circuit 6 may take the form of metal bars, of for example aluminum, copper or steel, or advantageously electrical conductors of superconducting material, the latter making it possible to reduce energy consumption, and because of their smaller mass than that of the equivalent metal conductors reducing the structural costs for supporting them or protecting them from any flows of metal by means of metal deflectors. Advantageously, these electrical conductors of superconducting material may be arranged so as to make several turns in series beneath the row or rows of cells.

The sum of the current intensities passing through the conductors of the compensating electrical circuit passing beneath the cell is advantageously of the order of 50% to 150% of the intensity of electrolysis current $I_1$, preferably of the order of 70% to 130% of the intensity of electrolysis current $I_1$, and even more preferably of the order of 80% to 120% of the intensity of electrolysis current $I_1$.

So if aluminum smelter 1 comprises a secondary compensating electrical circuit 6 forming a single turn beneath electrolytic cells 50, the intensity of the compensating current flowing through this compensating electrical circuit 6 may be of the order of 50% to 150% of the intensity of electrolysis current $I_1$. If this secondary compensating electrical sub-circuit 6 forms N turns beneath electrolytic cells 50, then the sum of the N current intensities passing through each of these turns will be of the order of 50% to 150% of the intensity of the electrolysis current. So according to the example in FIG. 5 the intensity of current $I_2$ corresponding to the sum of the intensities of currents $I_{20}$ and $I_{21}$ passing through each of the two turns may be of the order of 50% to 150% of the intensity of electrolysis current $I_1$.

The invention also relates to a process for stirring alumina in the electrolytic cells 50 of aluminum smelter 1. This process comprises a stage of modulating the intensity of the compensating current flowing in compensating electrical circuit 6, or, if applicable, the compensating currents flowing through the sub-circuits forming it. This modulation may more particularly be a function of the characteristics of the alumina, changes in the intensity of the electrolysis current or structural changes in the aluminum smelter.

This process of stirring the alumina comprises the stages of:

- analyzing at least one characteristic of the alumina (for example, the ability of the alumina to dissolve in the bath, the fluidity of the alumina, its solubility, its fluorine content, its moisture content, etc.),
- determining a value of the intensity of the compensating current which has to pass through the compensating circuit on the basis of the said at least one analyzed characteristic (this determination stage being performed using a nomograph obtained by experiment providing a relationship between the value of the current intensity and the characteristic analyzed) in order to produce a velocity threshold for MHD flows which is appropriate for effective stirring of the alumina while having the least possible effect on performance,
- changing the intensity of compensating current $I_2$ in accordance with the current intensity value determined in the previous stage.

Of course the invention is not in any way limited to the embodiment described above, this embodiment only being provided by way of example. Modifications are possible, in particular from the point of view of the constitution of the various components, or the substitution of equivalent techniques, without thereby going beyond the scope of protection of the invention. This invention is for example compatible with the use of anodes of the "inert" type at which oxygen forms in the course of the electrolysis reaction.

The invention claimed is:

1. An aluminum smelter comprising at least one row of electrolytic cells arranged transversely in relation to a length of the at least one row of electrolytic cells, each electrolytic cell of the at least one row of electrolytic cells comprising a pot shell, anode assemblies each comprising a support and at least one anode, and a cathode through which pass cathode conductors intended to collect an electrolysis current at the cathode to route the electrolysis current to cathode outputs outside the pot shell, characterized in that each electrolytic cell comprises rising and connecting electrical conductors to the anode assemblies running upwards along two opposite longitudinal edges of the electrolytic cell to conduct the electrolysis current to the anode assemblies of the respective electrolytic cell, and linking conductors connected to the cathode outputs designed to route the electrolysis current from the cathode outputs to the rising and connecting electrical conductors of a next electrolytic cell of the at least one row of electrolytic cells, and in that the aluminum smelter comprises at least one electrical compensating circuit running beneath the electrolytic cells, through which the at least one compensating circuit may flow a compensating current flowing beneath the electrolytic cells in a direction opposite to an overall direction of flow of the electrolysis current passing through the electrolytic cells located above.

2. Aluminum smelter according to claim 1, in which the at least one compensating electrical circuit is a secondary compensating electrical circuit separate from the electrical circuit through which the electrolysis current flows.

3. Aluminum smelter according to claim 1, characterized in that the at least one row of electrolytic cells comprises two rows of electrolytic cells arranged parallel to each other, supplied from a single station and electrically connected in series in such a way that the electrolysis current flowing in a first of the two rows of cells then flows in a second of the two rows of cells in a direction which is overall opposite to that in which the electrolysis current flows in the first of the two rows, and in that the compensating electrical circuit forms a loop beneath the two rows of electrolytic cells.

4. Aluminum smelter according to claim 1, characterized in that each electrolytic cell comprises a plurality of the rising and connecting electrical conductors distributed at predetermined intervals over substantially an entire length of the corresponding longitudinal edge along each of two longitudinal sides of each electrolytic cell.

5. Aluminum smelter according to claim 1, characterized in that the rising and connecting electrical conductors are arranged in a substantially symmetrical way in relation to a longitudinal median plane of each electrolytic cell.

6. Aluminum smelter according to claim 1, characterized in that the linking conductors run substantially straight beneath each electrolytic cell in a transverse direction in relation to each electrolytic cell.

7. Aluminum smelter according to claim 1, characterized in that the at least one compensating electrical circuit comprises electrical conductors forming a plurality of secondary compensating electrical sub-circuits which are independent of each other.

8. Aluminum smelter according to claim 7, in which the electrical conductors are substantially equally spaced and are arranged substantially symmetrically in relation to a transverse median axis of the electrolytic cells.

9. Aluminum smelter according to claim 1, characterized in that the at least one compensating electrical circuit comprises electrical conductors running in parallel beneath the electrolytic cells.

10. Aluminum smelter according to claim 1, characterized in that electrical conductors forming the at least one compensating electrical circuit run beneath the electrolytic cells, together forming a layer of between two and twelve parallel electrical conductors.

11. Aluminum smelter according to claim 1, characterized in that the rising and connecting electrical conductors running along one of the two opposite longitudinal edges of each electrolytic cell are in a staggered arrangement in relation to the rising and connecting electrical conductors located on an adjacent longitudinal edge of a separate preceding or following electrolytic cell.

12. Aluminum smelter according to claim 1, characterized in that each of the cathode outputs leaves the pot shell only in a vertical plane perpendicular to a longitudinal direction of each electrolytic cell.

13. Aluminum smelter according to claim 1, characterized in that the support for each anode assembly comprises a cross-member extending transversely in relation to the electrolytic cell, being supported and electrically connected at each of the two opposite longitudinal edges on either side of each electrolytic cell.

14. Aluminum smelter according to claim 1, characterized in that the rising and connecting electrical conductors run on either side of the pot shell, without running above the at least one anode.

15. Aluminum smelter according to claim 1, characterized in that the rising and connecting electrical conductors run at a height of between 0 and 1.5 meters above a substantially horizontal plane, including a surface of liquids present in each electrolytic cell.

16. Aluminum smelter according to claim 1, characterized in that the at least one compensating electrical circuit comprises electrical conductors running beneath the electrolytic cells, and wherein the compensating current flows through all of the electrical conductors of the at least one compensating electrical circuit running beneath the electrolytic cells in the direction opposite to the overall direction of flow of the electrolysis current passing through the electrolytic cells located above.

17. Method for using an aluminum smelter according to claim 1, comprising passing the compensating current through the at least one compensating electrical circuit beneath the electrolytic cells in the direction opposite to the overall direction of flow of the electrolysis current flowing through the electrolytic cells located above.

18. Method according to claim 17, characterized in that an intensity of the compensating current is of the order of 50% to 150% of an intensity of the electrolysis current.

19. Method according to claim 18, characterized in that the intensity of the compensating current is of the order of 70% to 130% of the intensity of the electrolysis current.

20. Method according to claim 17, characterized in that a distribution of current between the rising and connecting electrical conductors located upstream of each electrolytic cell and the rising and connecting electrical conductors located downstream of each electrolytic cell is of the order of 30-70% upstream and 30-70% downstream respectively.

21. Method according to claim 20, characterized in that the distribution of current between the rising and connecting electrical conductors located upstream of each electrolytic cell and the rising and connecting electrical conductors located downstream of each electrolytic cell is of the order of 40-60% upstream and 40-60% downstream respectively.

22. Method according to claim 21, characterized in that the distribution of current between the rising and connecting electrical conductors located upstream of each electrolytic cell and the rising and connecting electrical conductors located downstream of each electrolytic cell is of the order of 45-55% upstream and 45-55% downstream respectively.

23. Process for stirring alumina present in the electrolytic cells of an aluminum smelter according to claim 1, the process comprising:

analyzing of at least one characteristic of the alumina, determining an intensity value for an intensity of the compensating current which has to flow in the at least one compensating electrical circuit as a function of the at least one characteristic analyzed, changing the intensity of the compensating current to the intensity value determined, if the intensity of the compensating current differs from the intensity value.

* * * * *